US012275052B2

(12) United States Patent
Fujii et al.

(10) Patent No.: US 12,275,052 B2
(45) Date of Patent: Apr. 15, 2025

(54) PRESSED COMPONENT MANUFACTURING METHOD

(71) Applicant: JFE STEEL CORPORATION, Tokyo (JP)

(72) Inventors: Kento Fujii, Tokyo (JP); Toyohisa Shinmiya, Tokyo (JP); Yuji Yamasaki, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 675 days.

(21) Appl. No.: 17/438,350

(22) PCT Filed: Mar. 13, 2020

(86) PCT No.: PCT/JP2020/011188
§ 371 (c)(1),
(2) Date: Apr. 11, 2022

(87) PCT Pub. No.: WO2020/184711
PCT Pub. Date: Sep. 17, 2020

(65) Prior Publication Data

US 2022/0234089 A1 Jul. 28, 2022

(30) Foreign Application Priority Data

Mar. 14, 2019 (JP) ..... 2019-047362

(51) Int. Cl.
*B21D 22/26* (2006.01)

(52) U.S. Cl.
CPC ..... *B21D 22/26* (2013.01)

(58) Field of Classification Search
CPC . B21D 1/06; B21D 1/065; B21D 1/08; B21D 1/10; B21D 22/20; B21D 22/26; B21D 13/02; B21B 2015/0071
(Continued)

(56) References Cited

U.S. PATENT DOCUMENTS 9,962,752 B2 5/2018 Uchiyama et al.
2015/0367397 A1 12/2015 Uchiyama et al.
2017/0266706 A1 9/2017 Ito et al.

FOREIGN PATENT DOCUMENTS

CN 103341556 A 10/2013
CN 104918725 A 9/2015
(Continued)

OTHER PUBLICATIONS

Ken-ichiro Mori et al., "Small Hole Punching Using Local Resistance Heating for Die-Quenched Steel Sheets," Journal of Japan Society for Technology of Plasticity, vol. 52, No. 609, (2011), pp. 1114-1118.
Ken-ichiro Mori et al., "Punching of Ultra High Strength Steel Sheets Using Local Resistance Heating," Journal of Japan Society for Technology of Plasticity, vol. 51, No. 588, (2010), pp. 55-59.
"Sendankakou no saizensen," Proceedings of the 326th Symposium on Plasticity, 21-28.
(Continued)

*Primary Examiner* — Christopher L Templeton
*Assistant Examiner* — P Derek Pressley
(74) *Attorney, Agent, or Firm* — Oliff PLC

(57) ABSTRACT

A pressing technology for reducing tensile residual stress generated on a sheared edge face of a metal sheet after press forming in order to prevent occurrence of a delayed fracture on the sheared edge face. A pressed component manufacturing method for manufacturing a pressed component by press-forming a metal sheet having a sheared edge face includes a first press forming step in which it is estimated that tensile residual stress is generated in a direction along the sheared edge on a portion of the sheared edge face of the metal sheet after die release, in which the method includes, as a subsequent step to the first press forming step, a tensile residual stress relaxation step of bulging, in the sheet thickness direction, a region that includes at least a site on a sheared edge face where it is estimated that the tensile residual stress is generated.

7 Claims, 4 Drawing Sheets

(58) Field of Classification Search
USPC ..... 72/470
See application file for complete search history.

(56) References Cited

FOREIGN PATENT DOCUMENTS

| | | | | | |
|---|---|---|---|---|---|
| CN | 106180271 | A | * | 12/2016 | ..... B21D 1/10 |
| JP | 62134123 | A | * | 6/1987 | |
| JP | H07-171625 | A | | 7/1995 | |
| JP | H07-112574 | B2 | | 12/1995 | |
| JP | 2003-033828 | A | | 2/2003 | |
| JP | 2003311339 | A | * | 11/2003 | |
| JP | 2004-174542 | A | | 6/2004 | |
| JP | 2006-289480 | A | | 10/2006 | |
| JP | 2009255117 | A | * | 11/2009 | |
| JP | 2010069490 | A | * | 4/2010 | |
| JP | 2017170484 | A | * | 9/2017 | |

OTHER PUBLICATIONS

M. Murakawa, M. Suzuki, T. Shionome, F. Komuro, A. Harai, A. Matsumoto, and N. Koga, "Precision piercing and blanking of ultrahigh-strength steel sheets," Procedia Engineering, vol. 81, (2014), pp. 1114-1120.

Jun. 2, 2020 International Search Report issued in International Patent Application No. PCT/JP2020/011188.

Aug. 25, 2021 International Preliminary Report on Patentability issued in International Patent Application No. PCT/JP2020/011188.

Mar. 21, 2022 Search Report issued in European Patent Application No. 20769722.8.

Dec. 15, 2022 Office Action issued in Chinese Patent Application No. 202080020866.2.

* cited by examiner

PRESSED COMPONENT MANUFACTURING METHOD

TECHNICAL FIELD

The present invention relates to a technology for suppressing a delayed fracture that occurs from a sheared edge face of a pressed component made of metal sheet, after press forming.

BACKGROUND ART

At the present time, improvement in fuel consumption through weight reduction and improvement in collision safety are required for vehicles. Therefore, aimed at achieving both weight reduction of a vehicle body and passenger protection at the time of collision at the same time, high-strength steel sheets are used for bodies of vehicles. Recent years, in particular, there has been a tendency that ultrahigh-strength steel sheets having a tensile strength of 980 MPa or more are applied to vehicle bodies. One of the problems to be solved when a ultrahigh-strength steel sheet is applied to a vehicle body is a delayed fracture that occurs over time due to use. In particular, in pressing of a steel sheet having a tensile strength of 1470 MPa or more, a delayed fracture occurring from an edge face after shearing (hereinafter, also referred to as a sheared edge face) has become an important problem.

Note that it has been known that, in pressing involving shrink flange deformation in press forming, tensile residual stress is imparted to a sheared edge face by springback after die release.

In order to suppress a delayed fracture on a sheared edge face, it is required to reduce tensile residual stress on the sheared edge face.

Conventionally, in order to reduce tensile residual stress on a sheared edge face, methods of devising shearing, such as a method of increasing steel sheet temperature at the time of shearing (NPLs 1 and 2), a method of using a step punch at the time of punching (NPL 3), and a method by shaving (NPL 4 and PTL 1), have been widely developed.

Note that, in PTL 2, aimed at reducing springback and raising dimensional precision of components, imparting tensile stress to a part in which a shrink flange is formed, by forming a plurality of excess beads thereon and, in conjunction therewith, imparting compression stress to a part in which a stretch flange is formed, by forming an embossment thereon and flattening the embossment are described.

CITATION LIST

Non Patent Literature

NPL 1: Kenichiro Mori et al., Journal of Japan Society for Technology of Plasticity, 52-609 (2011), 1114-1118

NPL 2: Kenichiro Mori et al., Journal of Japan Society for Technology of Plasticity, 51-588 (2010), 55-59

NPL 3: Proceedings of the 326th Symposium on Plasticity "Sendankakou no saizensen", 21-28

NPL 4: M. Murakawa, M. Suzuki, T. Shinome, F. Komuro, A. Harai, A. Matsumoto, and N. Koga: Precision piercing and blanking of ultrahigh-strength steel sheets, Procedia Engineering, 81 (2014), pp. 1114-1120

PATENT LITERATURE

PTL 1: JP 2004-174542 A
PTL 2: JP 2009-255117 A

SUMMARY OF INVENTION

Technical Problem

However, the methods described in Non Patent Literatures and PTL 1 are countermeasure technologies against a delayed fracture at the time of shearing and are not technologies for reducing residual stress on a sheared edge face generated in a step of press-forming a metal sheet after shearing.

In addition, the method described in PTL 2 is a technology for reducing springback and is not a countermeasure technology against a delayed fracture. Further, excess beads described in PTL 2 are introduced to reduce compression stress on a shrink flange portion and are not a countermeasure aimed at reducing tensile residual stress on a sheared edge face that becomes a factor of a delayed fracture.

The present invention has been made in order to solve the above-described problems, and an object of the present invention is to provide a pressing technology that reduces tensile residual stress generated on a sheared edge face of a metal sheet after press forming.

Solution to Problem

In order to solve the above-described problem, the inventors have found that imparting a tensile deformation to a sheared edge face by imparting a bulging deformation to an edge face of a portion having shrink flange deformation caused by press forming in such a way as to forma bead enables tensile residual stress on the sheared edge face generated in springback deformation after die release to be reduced.

In order to solve the problem, according to one aspect of the present invention, a pressed component manufacturing method for manufacturing a pressed component by press-forming a metal sheet having a sheared edge face includes a first press forming step in which it is estimated that tensile residual stress is generated in a direction along a sheared edge on a portion of a sheared edge face of the metal sheet after die release, in which the method includes, as a subsequent step to the first press forming step, a tensile residual stress relaxation step of bulging, in a sheet thickness direction, a region including at least a site on a sheared edge face where it is estimated that the tensile residual stress is generated.

Advantageous Effects of Invention

The one aspect of the present invention enables tensile residual stress generated on a sheared edge face of a metal sheet after press forming to be reduced. As a result, according to the one aspect of the present invention, it is possible to improve delayed fracture-resistant characteristics when, for example, a high-strength steel sheet is applied to various types of components, such as a panel component and a structural and skeletal component, of a vehicle.

BRIEF DESCRIPTION OF DRAWINGS

FIGS. 2A and 2B are a plan view on an edge face side descriptive of an example of bulging and a side view viewed from a direction facing the edge face, illustrative of a bulging shape, respectively;

DESCRIPTION OF EMBODIMENTS

An embodiment of the present invention will now be described with reference to the drawings.

<Metal Sheet>

First, a metal sheet to be press-formed will be described.

A metal sheet exemplified in the present embodiment is made of a high-strength steel sheet having a possibility that a delayed fracture occurs at an edge over time after press forming due to tensile residual stress on a sheared edge face remaining after press forming. Although the present invention is suitably applicable to a high-strength steel sheet, of which a metal sheet is made, having a tensile strength equal to or greater than 590 MPa, the present invention is a technology effective for a high-strength steel sheet having a tensile strength equal to or greater than 980 MPa where there is particular concern for a delayed fracture, and is a technology more effective for a high-strength steel sheet having a tensile strength equal to or greater than 1180 MPa.

Note that tensile residual stress on a sheared edge face is also input when an edge is sheared.

Figure 1:
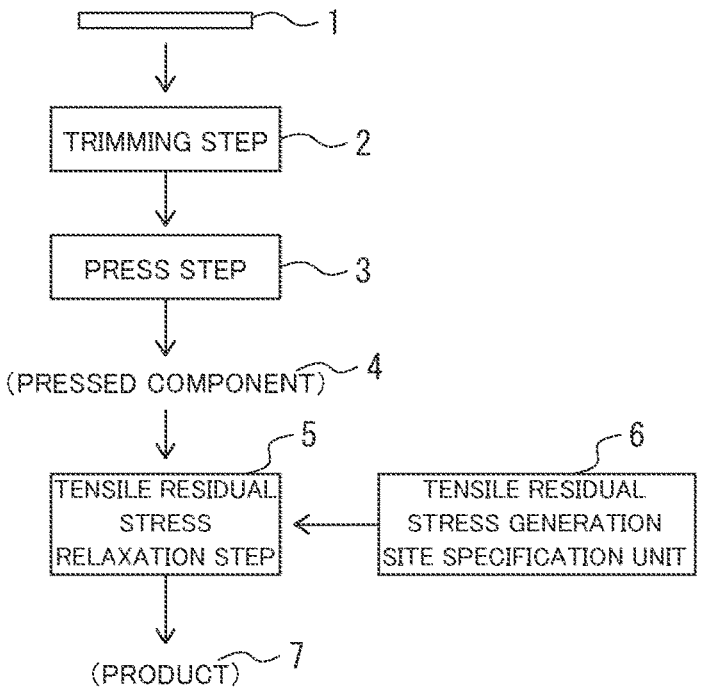
FIG. 1 is a diagram illustrative of an example of steps in a manufacturing method for a pressed component according to an embodiment based on the present invention.

As illustrated in FIG. 1, the present embodiment includes a trimming step 2 serving as a previous step to press forming, a press step 3, and a tensile residual stress relaxation step 5. The present embodiment also includes a tensile residual stress generation site specification unit 6.

<Trimming Step 2>

In the trimming step 2, a metal sheet 1 is cut into, for example, a contour shape corresponding to a component shape of a pressed component 4.

<Press Step 3>

In the press step 3, the metal sheet 1 after having been subjected to the trimming step 2 is subjected to press forming using a press die including an upper die and a lower die, and the pressed component 4 having a target component shape is manufactured. Note that the press forming is performed by, for example, stamping or drawing. The press step 3 constitutes a first press forming step.

As the shape of the pressed component 4 becomes more complex, the pressed component 4 is manufactured through more stages of press forming. When the pressed component 4 is manufactured through multistage press forming, press forming in which it is estimated that tensile residual stress is generated in a direction along a sheared edge on a portion of a sheared edge face of the metal sheet 1 after die release does not have to be final press forming. Note, however, that, when tensile residual stress is generated in press forming other than the final press forming in the multistage press forming, tensile residual stress remaining after the final press forming in the multistage press forming serves as tensile residual stress to be relaxed in the tensile residual stress relaxation step 5. In this case, a series of treatments in the multistage press forming or press forming, among the multistage press forming, in which it is estimated that tensile residual stress is generated in a direction along the sheared edge on a portion of the sheared edge face of the metal sheet 1 after die release serves as the first press forming step.

<Tensile Residual Stress Generation Site Specification Unit 6>

The tensile residual stress generation site specification unit 6 performs processing of specifying a generation site of tensile residual stress that is generated on the sheared edge face of the metal sheet after the press step 3 has been completed.

A first method for specifying a generation site of tensile residual stress is a method in which the sheared metal sheet 1 is actually press-formed and residual stress after die release of a press-formed product is directly measured. A second method for specifying a generation site of tensile residual stress is a method in which a generation site of tensile residual stress after die release is estimated by forming analysis.

The first method is performed by a destructive test method or a non-destructive test method. Destructive test methods include a sectioning method and a hole drilling method. When the sectioning method is used, measurement at a bending deformation-imparted portion of a press-formed product does not produce sufficient precision of measured values. When the hole drilling method is used, it is difficult to measure residual stress at a sheared edge. Non-destructive test methods include a residual stress measurement method using X-rays. Although this method enables residual stress at a sheared edge to be measured and sufficient precision to be achieved, this method is not practical because measurement takes a substantially long time.

From such a perspective, in the present embodiment, it is assumed that a generation site of tensile residual stress is specified using the following second method, that is, a method in which a generation site of tensile residual stress is estimated by forming analysis.

As the second method, a method in which forming analysis, represented by a finite element method, is performed and residual stress after die release is thereby estimated is preferable.

Although various conditions used for the forming analysis need to be set, any known method can be used for the setting. Note, however, that error in computational results of residual stress increases unless precision of the forming analysis is improved. A factor that significantly influences the precision is a model reproducing material behavior in the forming analysis. It is known that, in particular, applying a kinematic hardening model to a shape after die release causes precision to be improved, and it is thus preferable to perform forming analysis using a kinematic hardening model from a perspective of analysis precision. Kinematic hardening models include, for example, a linear kinematic hardening rule and a Yoshida-Uemori model. Although evaluation methods of forming analysis results in the present embodiment include a method of displaying stress distribution after die release as a contour diagram and a method of outputting and evaluating stress values from elements or nodes in a portion corresponding to a sheared edge, either method can be used. Note that it is assumed that, with regard to the direction of stress, stress in a direction along a sheared edge to be evaluated is dealt with. The reason for the assumption is that, in press forming, deformation that may occur at a sheared edge is a uniaxial tensile deformation, a bending deformation, or a composite deformation of a uniaxial tensile deformation and a bending deformation and the principal stress direction in the deformation is a direction along the sheared edge.

Although methods for determining, within a sheared edge face of the metal sheet 1 that is released from a die after press forming, an area including a sheared edge face on which tensile residual stress is generated in the direction along the sheared edge include a method of determining, as the area, a site in which, for example, tensile residual stress exceeds a predetermined stress value, a method of determining, as the area, a site in which elements in which tensile residual stress exceeds a predetermined stress value extend 10 mm or more along the sheared edge, a method of determining, as the area, a site in which elements in which tensile residual stress exceeds a predetermined stress value extend 3 mm or more in a direction perpendicular to the sheared edge, and the like, any of the methods can be used. The predetermined stress value is preferably determined according to the tensile strength, material, thickness, and the like of the metal sheet 1. Although methods for setting the predetermined stress value include, for example, a method of calculating a threshold value by multiplying the tensile strength of the metal sheet 1 by a coefficient, a method of multiplying yield stress in the metal sheet 1, equivalent plastic strain in the metal sheet 1, and a coefficient by one another, and the like, any of the methods can be used. The predetermined stress value is set to, for example, 200 MPa. When the metal sheet 1 is a high-strength steel sheet having a tensile strength of 1180 MPa, the predetermined stress value is set to, for example, 100 MPa.

The tensile residual stress generation site specification unit 6 may simply specify a sheared edge face of a portion subjected to shrink flanging in the press forming as a site where it is estimated that tensile residual stress is generated.

<Tensile Residual Stress Relaxation Step 5>

Figure 2A:
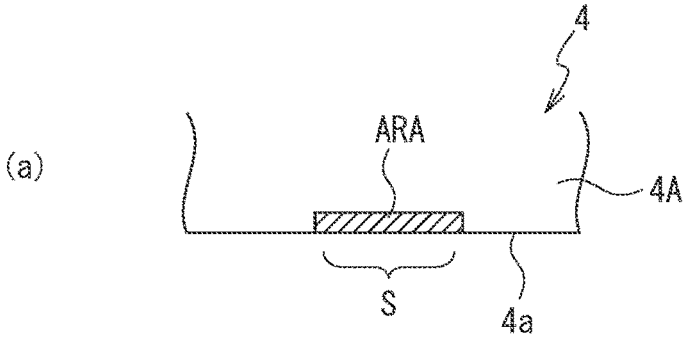
FIGS. 2A and 2B are diagrams descriptive of an example of bulging in a tensile residual stress relaxation step.
Figure 2B:
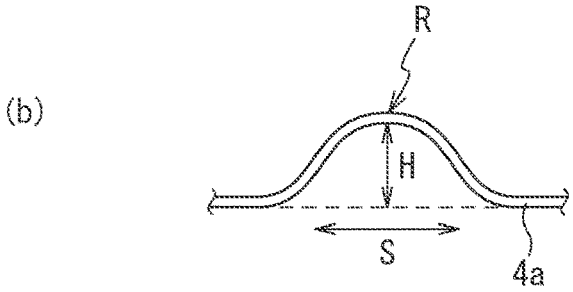

The tensile residual stress relaxation step 5 bulges, in the sheet thickness direction, an area ARA including a site S on a sheared edge face where it is estimated that tensile residual stress is generated and that is specified by the tensile residual stress generation site specification unit 6, with respect to the pressed component 4 press-formed into a target component shape in the press step 3 (see FIG. 2). The area ARA to be bulged may be set to an area extending in the direction along the sheared edge beyond an area including the site S on the sheared edge face where it is estimated that tensile residual stress is generated.

The area ARA to be bulged is set in such a way that tensile deformation in the direction along the sheared edge that is generated in association with the bulging expands to the entire area of the site on the sheared edge face where it is estimated that tensile residual stress is generated.

When an area extending in the direction along the sheared edge beyond the site S on the sheared edge face where it is estimated that tensile residual stress is generated is bulged by the bulging, tensile deformation in the direction along the sheared edge that is generated in association with the bulging surely expands to the entire area of the site S on the sheared edge face where it is estimated that tensile residual stress is generated.

Figure 3:
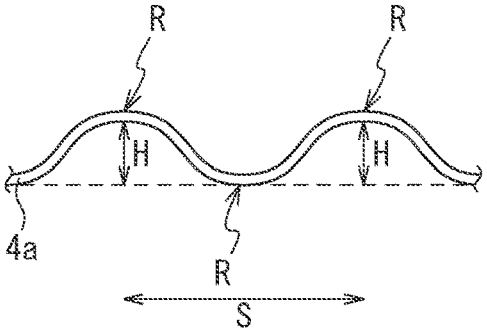
FIG. 3 is a side view viewed from a direction facing an edge face, descriptive of another example of a bulging shape.

The bulging shape formed by the bulging is, when the shape is viewed from the side facing the sheared edge face, formed into, for example, a circular-arc shape (a bead shape the cross-section of which is a circular-arc shape), as illustrated in FIG. 2. The bulging shape may be constituted by, for example, a waveform shape in which bead shapes or circular-arc shapes extending in the direction along the sheared edge continue as illustrated in FIG. 3.

The bulging shape is preferably formed into a bulging shape the bulge height H of which is equal to or greater than 10 mm and the radius R of curvature of which in the direction along the sheared edge at the bulge peak portion is equal to or greater than 5 mm. The bulge height H is defined to be height at the peak of the bulging shape. Note that a profile of the bulging shape preferably has a radius R of curvature equal to or greater than 5 mm at any site along the end edge direction.

The upper limit of the radius R of curvature is not specifically limited as long as the radius R of curvature is equal to or greater than 5 mm. The radius R of curvature being infinite indicates that the cross-section is flat.

Although the radius R of curvature can be either radius of curvature of the surface on the convex side of the bulging shape or radius of curvature of the surface on the concave side thereof, it is assumed that, in the present embodiment, the radius R of curvature is radius of curvature of the surface on the convex side.

The bulge peak portion is set in such a way as to be positioned within the site S on the sheared edge face in the direction along the sheared edge (see FIG. 2). When a bulge peak portion is arranged within the site S on the sheared edge face, the bulge peak portion is preferably formed at a central portion of the site S on the sheared edge face in the direction along the sheared edge. The central portion is, for example, a position of the central partition when the site S on the sheared edge face is divided into three equal partitions.

The upper limit of the bulge height H is 200 mm. When the bulge height H exceeds the upper limit, strain occurring at the sheared edge at the time of press forming becomes large and there is a possibility that a stretch flange occurs. There is also a possibility that wrinkles, which is one of forming defects, occur in the press-formed product. The bulge height H is more preferably set to 100 mm or less.

In the bulging, when length before bulging of a bulged portion along the sheared edge is denoted by X0 and length after bulging of the bulged portion along the sheared edge is denoted by X1, a curve length difference between before and after bulging preferably satisfies the formula (A) below:

$$X1>1.03\cdot X0 \quad \text{(A)}.$$

Note that the upper limit of the curve length difference (X1−X0) between before and after bulging is naturally defined from the bulge height H and the radius R of curvature.

The above-described bulging shape is a shape at an edge face of the metal sheet 1, and bulging shapes of other portions are not specifically limited. From a viewpoint of not largely deforming the component shape produced in the press step 3, the bulging shape of other portions are only required to be set in such a way that the bulge height H of the above-described bulging shape continuously decreases from the edge face toward the inner side, that is, as the location is further away from the edge face along the surface of the metal sheet 1. In other words, it is only required that only an edge face vicinity is bulged. The edge face vicinity is, for example, a range of 10 mm or less from the edge face, and preferably a range of 5 mm or less. Limiting the edge face vicinity to this range enables influence of the pressed component 4 manufactured in the press step 3 on the component shape to be suppressed small.

<Other Configurations>

As a subsequent step to the tensile residual stress relaxation step 5, press forming that decreases the bulge height H of the bulging shape at the edge, which is formed in the tensile residual stress relaxation step 5, may be performed.

A component shape including the bulging shape formed in the tensile residual stress relaxation step 5 may be designed as a shape of a product 7, and a pressed component 4 produced in the press step 3 may be designed in such a way as to be formed into a shape in which the bulging shape is made flat.

The bulging by the tensile residual stress relaxation step 5 may be performed on, without being limited to a portion of a sheared edge face where it is estimated that tensile residual stress is generated, the whole area of the sheared edge face.

<Effects and Others>

<Mode of Tensile Residual Stress Generation>

Description will be made below using, as an example, a case where square cup drawing is performed in the press step 3 and tensile deformation occurs on a sheared edge face of a press-formed product.

When, in the press step 3, square cup drawing is performed on a central portion of the square metal sheet 1, the central portion of the metal sheet 1 is deformed into a square cup shape while material inflow associated with the drawing occurs. On this occasion, a portion of the sheared edge on a flange portion at the outer periphery of the square cup is subjected to deformation involving shrinkage in the direction along the sheared edge, that is, shrink flange deformation. Compression stress due to the shrink flange deformation has been generated on a portion of the sheared edge in association with the square cup drawing, and, on the other hand, tensile stress associated with inflow difference of the sheared edge and frictional resistance has also been generated in the vicinity of a portion subjected to the shrink flange deformation. Thus, a non-uniform stress distribution has occurred along the sheared edge. As described above, on the pressed component 4 constrained by a die, a non-uniform stress distribution has occurred due to press forming. When, from this state, the pressed component 4 is released from the die and the non-uniform stress distribution is released from the constraint, internal stress remains in the pressed component 4 and becomes residual stress. Tensile stress among the residual stress becomes a factor of occurrence of a delayed fracture on the pressed component 4 after press forming.

(Tensile Residual Stress Reduction Method)

As a result of earnest studies, the inventors have found that subjecting an edge of a component in which there remains tensile residual stress as described above after press forming to bulging deformation enables the tensile residual stress to be reduced. The tensile residual stress reduction will be described as follows.

A principal factor of the generation of tensile residual stress on a sheared edge of a press-formed product is that a non-uniform stress distribution including tensile stress and compression stress generated during forming occurs, as described afore. In the present embodiment, in order to eliminate the non-uniform stress distribution, a portion in which tensile residual stress is generated is subjected to uniform deformation in the tensile residual stress relaxation step 5. Specifically, in the tensile residual stress relaxation step 5, curve length of the sheared edge of the tensile residual stress generation portion is increased by a bulging shape formed by bulging, and tensile deformation not including compression is thereby imparted to the sheared edge. This treatment causes tensile stress generated during forming to be released after release of a die for bulging and enables tensile residual stress to be reduced.

The bulging shape preferably satisfies the following conditions (1) to (3):

(1) a plastic deformation can be imparted to the sheared edge, specifically, a portion in which tensile residual stress has been generated, by the bulging deformation;

(2) a tensile deformation is imparted to the sheared edge, specifically, an area wider than an area in which tensile residual stress has been generated, by bulging deformation; and (3) after tensile stress has been imparted to the sheared edge by bulging deformation, the tensile stress is sufficiently released at the time of die release.

When the condition (1) is not satisfied, the sheared edge returns to the original shape after die release, which causes tensile stress to remain as it is.

When the condition (2) is not satisfied, there is a possibility that an area in which tensile residual stress is high remains on the sheared edge and there is also a possibility that occurrence of a delayed fracture cannot be sufficiently suppressed.

When the condition (3) is not satisfied, there is a possibility that a delayed fracture occurrence risk site is newly generated by bulging, such as bead forming.

Because of the reasons described above, a bulging shape that can sufficiently exert an effect of the present embodiment is subject to restrictions.

As a result of intensive studies by the inventors, it is found that, when bulge height H is equal to or greater than 10 mm and radius R of curvature of the peak portion of a bulging shape is equal to or greater than 5 mm, the above conditions (1) to (3) are satisfied, a plastic deformation can be imparted to a portion of the sheared edge in which tensile residual stress has been generated, by bulging deformation, and tensile residual stress on the sheared edge face after press forming can be reduced.

When the radius R of curvature of the peak portion of the bulging shape is less than 5 mm, the peak portion is formed into a shape locally accompanied by a large deformation, by bulging and tensile stress remains after die release, and there is thus a possibility that the tensile stress becomes a factor of occurrence of a delayed fracture.

When the bulge height H is less than 10 mm, a plastic deformation cannot be sufficiently imparted to the portion of the sheared edge in which tensile residual stress has been generated, and there is thus a possibility that delayed fracture suppression effect cannot be expected. It is more preferable that the bulge height H be set to 20 mm or more and the radius R of curvature of the peak portion of the bulging shape be set to 10 mm or more.

As required by the afore-described condition (2), a tensile deformation is required to be imparted to the bulging shape, specifically, an area wider than an area in which tensile residual stress has been generated at the sheared edge, by bulging deformation. As a result of earnest studies, it is found that, when width of a bulging shape in the direction along the sheared edge of the metal sheet 1 is denoted by L1 and length of an area in which a result of forming analysis after die release, the forming analysis being performed on the metal sheet 1, indicates that the tensile residual stress is generated on the sheared edge face is denoted by L0, a bulging shape satisfying "L1>L0" enables the condition (2) to be surely satisfied. This is because such a bulging shape causes an area wider than an area in which tensile residual stress remains along the sheared edge to be bulged and a tensile deformation to be imparted to the area. It is more preferable that a bulging shape having a size satisfying "L1>1.1·L0" be formed.

Note that the upper limit of L1 is naturally defined from the bulge height H and the radius R of curvature.

As required by the afore-described condition (1), it is required to be able to impart a plastic deformation to a portion in which tensile residual stress has been generated at the sheared edge, by bulging deformation. As a result of earnest studies, it is confirmed that, at the time of bulging of the metal sheet 1, when length before bulging of a bulged portion along the sheared edge of the metal sheet 1 is denoted by X0 and length after bulging of the bulged portion along the sheared edge of the metal sheet 1 is denoted by X1, a bulging shape satisfying "X1>1.03·X0" enables the afore-described condition (1) to be satisfied. Although distribution occurs on imparted strain in a portion to which a bulging shape is imparted, satisfying the formula "X1>1.03·X0" enables a plastic deformation to be imparted to the entire area in which tensile residual stress has been generated at the sheared edge and tensile stress in the entire area in which tensile residual stress has been generated at the sheared edge to be thereby reduced. It is more preferable that a bulging shape satisfying "X1>1.10·X0" be formed.

As described above, according to the present embodiment, it is possible to reduce tensile residual stress on a sheared edge face of a metal sheet after press forming. As a result, according to the present embodiment, it is possible to improve, for example, delayed fracture-resistant characteristics when a high-strength steel sheet is applied to various types of components, such as a panel component and a structural and skeletal component, of a vehicle.

Example

Next, an example based on the present invention will be described.

In this example, description will be made targeting a 1470 MPa class cold-rolled steel sheet having mechanical characteristics shown in Table 1.

TABLE 1

| Yield stress YS (MPa) | Tensile strength TS (MPa) | Total elongation El (%) | Sheet thickness t (mm) |
|---|---|---|---|
| 1261 | 1513 | 8.1 | 1.4 |

Figure 4A:
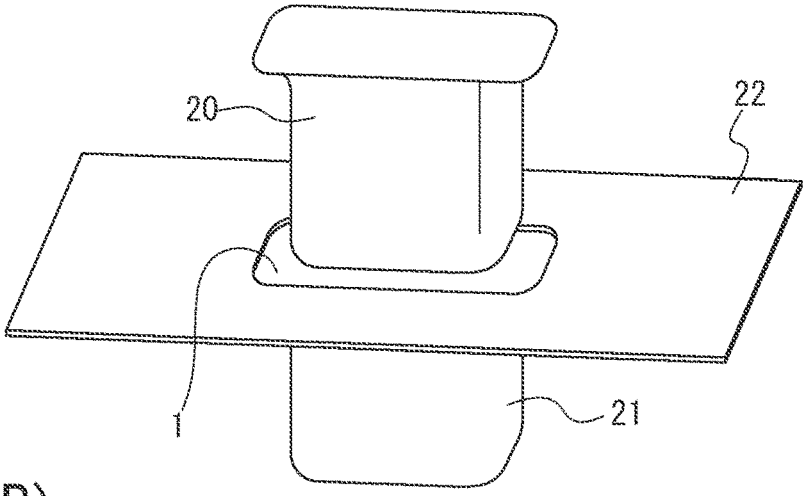
FIGS. 4A and 4B are diagrams descriptive of a first press forming step in an example.
Figure 4B:
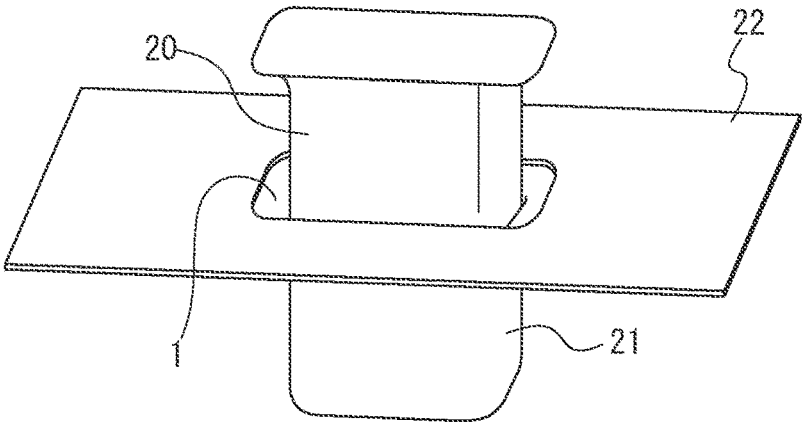

As a press step (hereinafter, also referred to as a first step), square cup drawing was performed on a metal sheet 1 that was sheared into a square shape with sides of 400 mm×400 mm, using a die as illustrated in FIG. 4. In other words, while the outer periphery of the metal sheet 1 was constrained by a blank holder 22 and a die 21, press forming was performed by moving a punch 20 toward the die 21.

Punch R and forming depth were set to 25 mm and 25 mm, respectively.

Figure 5:
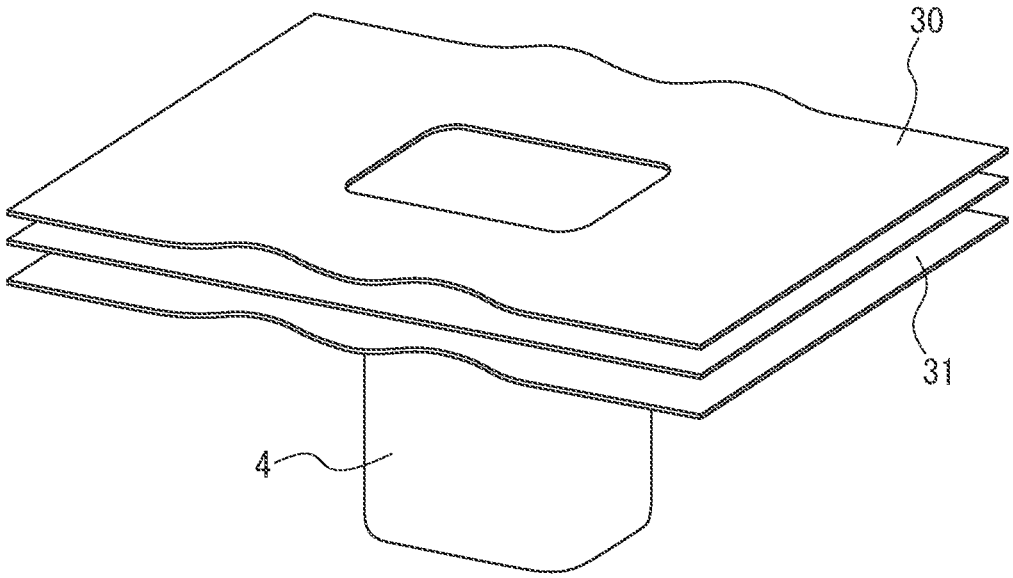
FIG. 5 is a diagram illustrative of a die used in a tensile residual stress relaxation step in the example.
Figure 6:
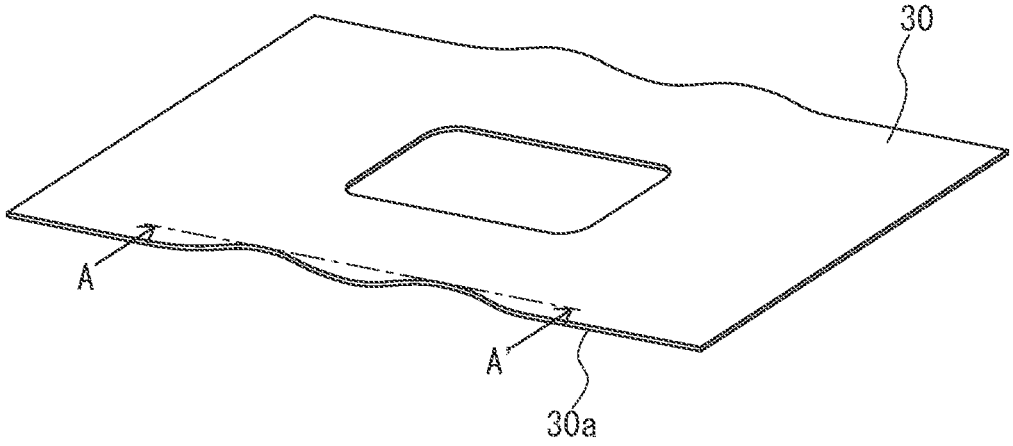
FIG. 6 is a diagram illustrative of a bead shape of the die used in the tensile residual stress relaxation step in the example.
Figure 7:
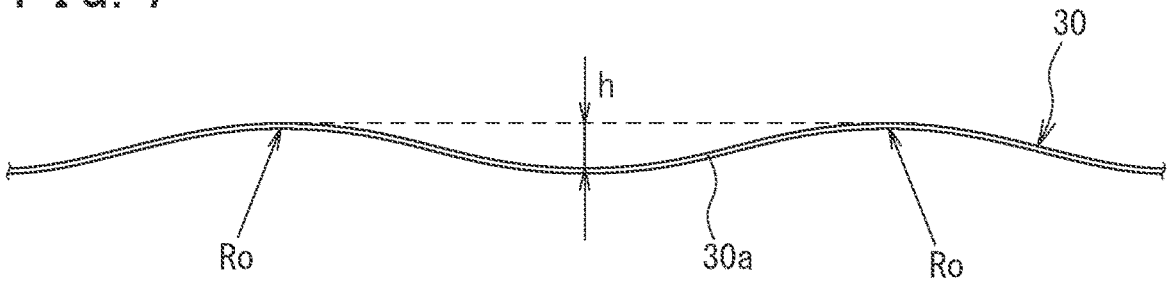
FIG. 7 is a diagram illustrative of the bead shape at a position of an edge face taken along the line A-A' in FIG. 6.

Next, as a tensile residual stress relaxation step (hereinafter, also referred to as a second step), a specimen was manufactured by subjecting the flange portion of the metal sheet 1, on which square cup drawing was performed, to press forming, using a press die composed of an upper die 30 and a lower die 31 that have wavelike bead shapes as illustrated in FIGS. 5 to 7. The bead shapes of the upper die 30 and the lower die 31 are the same shape, and, as illustrated in FIG. 7, a bead shape with height h and bending radius R0 is transferred on an edge of the metal sheet by press forming. In other words, bulging for imparting a bulging shape of a waveform that continues along the end edge was performed on the sheared edge face of the metal sheet.

Note that the bead shape is set in such a way that the height continuously decreases from the edge toward the inside.

On this occasion, a plurality of specimens were manufactured changing the bulge heights of formed bulging shapes and the radii of curvature of the peak portions thereof, as shown in Table 2.

Next, in order to simulate a delayed fracture with respect to each manufactured specimen, an immersion test was performed.

A chemical solution used for immersion in the immersion test was formed by combining an $NH_4SCN$ solution with a concentration of 0.1% and a McILVAINE buffer solution, and the pH thereof was set to 5.6. Immersion time was set to 24 hours.

Occurrence or non-occurrence of a crack occurring from the sheared edge face after immersion was confirmed, and a result of the confirmation was used as a result of simulative determination of occurrence of a crack due to a delayed fracture.

Forming analysis of forming by square cup drawing and bulging was performed, and stress generated at the sheared edge was computed. The forming analysis was performed on a quarter-part model in consideration of symmetry. Residual stress after die release was evaluated in the forming analysis, using a Yoshida-Uemori model as a material model.

Figure 8:
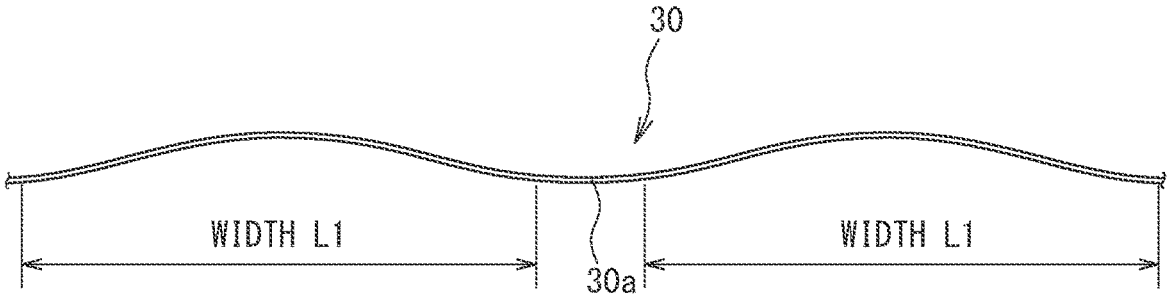
FIG. 8 is diagrams descriptive of width L1 of a bulging shape in the example.
Figure 9:
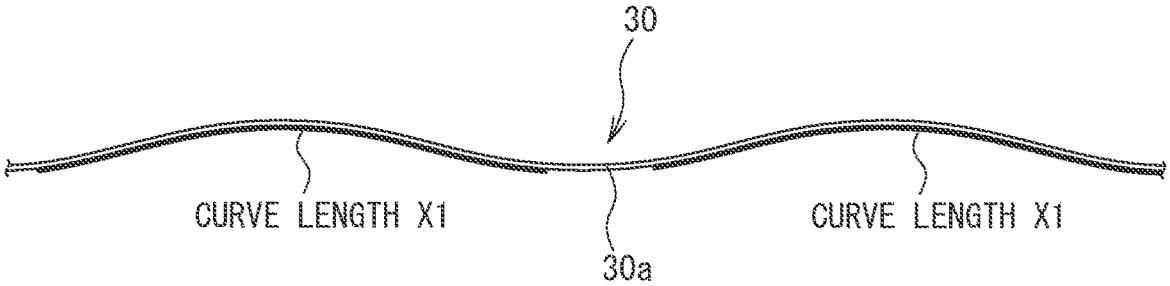
FIG. 9 is diagrams illustrative of curve length X1 after bulging in the example.

Results of the immersion test and residual stress measurement of specimens formed using dies having bulging shapes are shown in Tables 2 to 4. In this example, width L1 of a bulging shape is length of portions at positions illustrated in FIG. 8. Curve length X1 after forming is length of portions of a curve at positions illustrated in FIG. 9.

TABLE 2

| Bulge height in second step [mm] | Radius of curvature in second step [mm] | Occurrence/ non-occurrence of crack by immersion test (○: no crack, X: crack occurred) | Residual stress at sheared edge in forming analysis [MPa] | Note |
|---|---|---|---|---|
| | | X | 684 | Forming only in first step |
| 5 | 308 | X | 530 | Height has influence |
| 10 | 104 | ○ | 218 | |
| 20 | 55 | ○ | 164 | |
| 30 | 38 | ○ | 144 | |
| 40 | 30 | ○ | 79 | Height and radius have influence |
| | 20 | ○ | 81 | Radius has influence |
| | 10 | ○ | 227 | |
| | 5 | ○ | 384 | |
| | 3 | X | 508 | |

TABLE 3

| Bulge height in second step [mm] | Radius of curvature in second step [mm] | L1/L0 | Occurrence/ non-occurrence of crack by immersion test (○: no crack, X: crack occurred) | Residual stress at sheared edge in forming analysis [MPa] | Note |
|---|---|---|---|---|---|
| | | | X | 684 | Forming only in first step |
| 20 | 55 | 1.4 | ○ | 168 | Width in relation to tensile residual stress region has influence |
| | | 1.2 | ○ | 197 | |
| | | 1.1 | ○ | 268 | |
| | | 1.0 | X | 497 | |

TABLE 4

| Bulge height in second step [mm] | Radius of curvature in second step [mm] | X1/X0 | Occurrence/ non-occurrence of crack by immersion test (○: no crack, X: crack occurred) | Residual stress at sheared edge in forming analysis [MPa] | Note |
|---|---|---|---|---|---|
| | | | X | 684 | Forming only in first step |
| 10 | 104 | 1.15 | ○ | 218 | Curve length in relation to tensile residual stress region has influence |
| | | 1.05 | ○ | 357 | |
| | | 1.03 | X | 448 | |
| | | 1.02 | X | 512 | |

As evident in Table 2, a crack caused by the immersion test occurred when the bulge height of a bulging shape was 5 mm, and a crack caused by the immersion test was avoided when the bulge height was 10 mm to 40 mm.

Reduction effect of residual stress at the sheared edge was also confirmed. With regard to the radius of curvature of a peak portion, a crack caused by the immersion test was avoided when the bulge height H was 40 mm and the radius of curvature of the peak portion was 5 mm to 30 mm. On the other hand, a crack occurred when the radius of curvature of the peak portion was 3 mm.

From the above description, it can be said that it is appropriate that the height of the bulging shape is equal to or greater than 10 mm and the radius of curvature of the peak portion of the bulging shape is equal to or greater than 5 mm.

As evident in Table 3, when the bulge height H was 20 mm and the radius of the peak portion was 55 mm, no crack caused by the immersion test occurred when a ratio (L1/L0) of L1 to L0 was in a range of 1.1 or more and 1.4 or less, and a crack occurred when the ratio (L1/L0) was 1.0. From the above result, it can be said that it is appropriate that L1 and L0 are set in such a way as to satisfy L1>L0.

As evident in Table 4, when the bulge height was 10 mm and the radius of curvature of the peak portion was 104 mm, no crack caused by the immersion test occurred when a ratio (X1/X0) of X1 to X0 was 1.05 and 1.15, and a crack occurred when the ratio (X1/X0) was 1.02 and 1.03. From the above result, it can be said that it is appropriate that, with regard to the curve length difference between the length X0 before forming and the length X1 after forming of the bulging shape, the length X0 and the length X1 are set in such a way as to satisfy X1>1.03·X0.

This application claims priority based on Japanese Patent Application No. 2019-047362, filed on Mar. 14, 2019, the entire disclosure of which is incorporated herein by reference. Hereinbefore, the invention is described with reference to the limited number of embodiments, but the scope of the invention is not limited thereto, and modifications of the respective embodiments based on the above description will be obvious to those skilled in the art.

REFERENCE SIGNS LIST

1 Metal sheet
2 Trimming step
3 Press step (first press forming step)
4 Pressed component
5 Tensile residual stress relaxation step
6 Tensile residual stress generation site specification unit
7 Product

The invention claimed is:

1. A pressed component manufacturing method for manufacturing a pressed component by press-forming a metal sheet having a sheared edge face, the method comprising a first press forming step in which it is estimated that tensile residual stress is generated in a direction along a sheared edge on a portion of the sheared edge face of the metal sheet after die release, wherein the method includes, as a subsequent step to the first press forming step, a tensile residual stress relaxation step of bulging, in a sheet thickness direction, an area including at least a site on the sheared edge face where it is estimated that the tensile residual stress is generated, the method sets a bulging shape formed by bulging in the tensile residual stress relaxation step in such a way that bulge height decreases as a location is further away from the sheared edge face, and in bulging in the tensile residual stress relaxation step, when length before bulging of a bulged portion along the sheared edge is denoted by X0 and length after bulging of the bulged portion along the sheared edge is denoted by X1, the method satisfies a formula below:

$$X1>1.03\cdot X0.$$

2. The pressed component manufacturing method according to claim 1, wherein the method performs forming analysis of the metal sheet and specifies a site where it is estimated that the tensile residual stress is generated from a result of the forming analysis after die release.

3. The pressed component manufacturing method according to claim 2, wherein in bulging in the tensile residual stress relaxation step, the method forms the sheared edge face into the bulging shape with the bulge height equal to or greater than 10 mm and a radius of curvature in a direction along a sheared edge at a bulge peak portion equal to or greater than 5 mm.

4. The pressed component manufacturing method according to claim 2, wherein tensile strength of the metal sheet is equal to or greater than 980 MPa.

5. The pressed component manufacturing method according to claim 1, wherein in bulging in the tensile residual stress relaxation step, the method forms the sheared edge face into the bulging shape with the bulge height equal to or greater than 10 mm and a radius of curvature in a direction along a sheared edge at a bulge peak portion equal to or greater than 5 mm.

6. The pressed component manufacturing method according to claim 5, wherein tensile strength of the metal sheet is equal to or greater than 980 MPa.

7. The pressed component manufacturing method according to claim 1, wherein tensile strength of the metal sheet is equal to or greater than 980 MPa.

* * * * *